US006419408B1

(12) United States Patent
Inada

(10) Patent No.: US 6,419,408 B1
(45) Date of Patent: Jul. 16, 2002

(54) DEVELOPING PROCESS AND DEVELOPING UNIT

(75) Inventor: Hiroichi Inada, Kumamoto (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/262,865

(22) Filed: Mar. 5, 1999

(30) Foreign Application Priority Data

Mar. 9, 1998 (JP) ..... 10-074906

(51) Int. Cl.[7] ..... G03D 5/04

(52) U.S. Cl. ..... 396/604; 396/611; 396/626; 396/627

(58) Field of Search ..... 396/604, 611, 396/627, 626; 118/305, 319–321, 666–668, 389; 430/5, 311

(56) References Cited

U.S. PATENT DOCUMENTS 4,688,918 A * 8/1987 Suzuki et al. ..... 396/611
5,779,796 A * 7/1998 Tomoeda et al. ..... 118/319
5,854,953 A * 12/1998 Semba ..... 396/611

FOREIGN PATENT DOCUMENTS

JP 56-144444 A * 11/1981
JP 06-187672 A * 7/1994

* cited by examiner

*Primary Examiner*—D. Rutledge
(74) *Attorney, Agent, or Firm*—Rader, Fishman & Grauer, PLLC

(57) ABSTRACT

When a developing process is performed, a mixture of developing solution and pure water is supplied while the ratio of developing solution and pure water is gradually increased from pure water to developing solution. Thus, a developing solution component and a resist component gradually react. Even if a resist component dissolves in the mixture of pure water and developing solution, the equality of the concentration of the developing solution can be maintained. Thus, the developing process can be suppressed from being unequally performed. When a rinsing process is performed, a mixture of developing solution and pure water is supplied while the ratio of developing solution against pure water is gradually decreased from developing solution to pure water. Consequently, the substitution from developing solution to pure water can be gradually performed. As a result, particles due to the solidification of unsolved resist can be prevented.

15 Claims, 14 Drawing Sheets

PRIOR ART

DEVELOPING PROCESS AND DEVELOPING UNIT

BACKGROUND OF THE INVENTION

1. Field of the Invention

The present invention relates to a developing process and a developing unit for supplying developing solution to the front surface of a substrate such as a semiconductor wafer or an LCD substrate.

2. Description of the Related Art

In a resist process of a semiconductor fabrication, resist solution is coated as a resist film on the front surface of a substrate such as a semiconductor wafer (referred to as wafer). A predetermined pattern is formed on the front surface of the wafer by an exposing unit. Developing solution is coated to the front surface of the wafer. Thereafter, a rinsing process for rinsing the developing solution with pure water is performed.

Developing solution is supplied as a liquid layer to the front surface of the wafer. In this state, the developing process is performed for a predetermined time period. In the developing process, a positive photoresist of which an exposed portion is dissolved with developing solution has been widely used because a high resolution can be obtained.

In the developing process, a developing solution supplying nozzle portion having a plurality of spray openings arranged along a straight line is used. While the wafer is rotated at low speed, the developing solution is sprayed from the developing solution supplying nozzle portion to the front surface of the wafer. Thus, the developing solution is equally supplied from the developing solution supplying nozzle portion to the front surface of the wafer. In the rinsing process, while the wafer is rotated at high speed, pure water is supplied from a pure water supplying nozzle portion to the front surface of the wafer.

As the integration of devices are becoming high, photolithography technologies corresponding to fine design rules are desired. In this case, technologies for accurately exposing and developing a fine circuit pattern against a resist film are required. Thus, a short wavelength light source required for the exposing process should be used. In addition, the concentration and temperature of developing solution used for the developing process should be accurately controlled. In particular, with respect to the concentration of the developing solution, when the developing solution is coated as a liquid layer on the front surface of the wafer, the concentration of the developing solution should be equal on the entire front surface. In this case, since the line width of a fine circuit pattern can be suppressed from fluctuating, an equal line width can be developed.

However, in the conventional developing process, as shown in FIG. 18, when developing solution is coated as a liquid layer and an exposed portion of a resist film 101 is dissolved with the developing solution 100, a resist component dissolves in the developing solution and thereby the equality of the concentration of the developing solution deteriorates. When developing solution 102 reacts with the resist film 101, the reaction speed of the developing solution 102 becomes higher than that of the pure developing solution 100. Thus, as shown in FIG. 18, the developing speed of the resist film 101 coated with the developing solution 102 as a liquid layer reacted with the resist film 101 is different from the developing speed of the resist film 101 coated with the pure developing solution 100 as a liquid layer. Thus, as the developing process advances, the equality of the concentration of the developing solution deteriorates. Consequently, since the front surface of the wafer is unequally developed, the line width of the circuit pattern may deviate to some extent. In addition, as described above, since a high resolution circuit pattern has been required, a slight deviation of the line width may cause the yield to deteriorate. Technologies that effectively solve such a problem have not been proposed.

In addition, when a rinsing process is performed for a wafer that has been developed, if pure water is directly supplied to the front surface of the wafer, a resist component that has not dissolved in the developing solution on the front surface of the wafer solidifies. The solidified component adheres to the front surface of the wafer and thereby particles take place.

In addition, as the productivity improves, the throughput of the developing unit should be also improved. However, in the conventional developing unit, a developing solution supplying nozzle portion and a rinse solution supplying nozzle portion should be separately operated. These supplying nozzle portions should be switched corresponding to the developing process and the rinsing process. Thus, it takes a time to switch the operation of the developing solution supplying nozzle portion to the operation of the rinse solution supplying nozzle portion. Consequently, with the conventional developing unit, the throughput cannot be improved. In addition, to operate the developing solution supplying nozzle portion and the rise solution supplying nozzle portion, at least two driving means are required. Thus, the structure of the entire unit is complicated and the size thereof becomes large.

SUMMARY OF THE INVENTION

Therefore, an object of the present invention is to provide a developing method and a developing unit that allow the equality of the concentration of developing solution to be maintained.

Another object of the present invention is to provide a developing method and a developing unit that allow a developing process to be smoothly advanced to a rinsing process.

A further object of the present invention is to provide a developing method and a developing unit that allow a process time to be shortened and the structure of the unit to be simplified.

A first aspect of the present invention is a method for performing a developing process for the front surface of a substrate, comprising the steps of (a) supplying a mixture of developing solution and pure water to the front surface of the substrate, and (b) supplying developing solution to the front surface of the substrate, wherein the step (b) is preceded by the step (a).

According to the first aspect of the present invention, when the developing process is performed, after pure water is supplied to the front surface of a substrate, while the mixing ratio of a mixture of developing solution and pure water is gradually increased, the mixture is supplied. Thus, processing solution supplied to the front surface of the substrate is substituted from pure water to developing solution. Consequently, a developing component gradually reacts with a resist component. Even if the resist component dissolves in the mixture of the developing solution and the pure water, the equality of the concentration of the developing solution can be properly maintained. As a result, the developing process can be suppressed from being unequally performed.

A second aspect of the present invention is a method for performing a developing process for the front surface of a substrate, comprising the steps of (a) supplying developing solution to the front surface of the substrate, and (b) supplying a mixture of developing solution and pure water to the front surface of the substrate.

According to the second aspect of the present invention, when the rinsing process is performed, while the mixing ratio of a mixture of developing solution and pure water is gradually decreased, the mixture is supplied to the front surface of the substrate. Thus, the processing solution supplied to the front surface of the substrate is substituted from the developing solution to the pure water. Thus, the substitution from the developing solution to the pure water can be gradually performed. Consequently, particles due to the solidification of unsolved resist can be prevented.

A third aspect of the present invention is a unit for supplying developing solution to the front surface of a substrate, comprising a first supplying path for supplying the developing solution, a second supplying path for supplying pure water, a mixing portion, connected to the first supplying path and the second supplying path, for mixing the developing solution supplied from the first supplying path and the pure water supplied from the second supplying path, and a spraying portion for spraying solution mixed by the mixing portion to the substrate.

According to the third aspect of the present invention, the developing process and the rinsing process can be performed with one means. Thus, the process time can be shortened and the developing unit can be simplified.

These and other objects, features and advantages of the present invention will become more apparent in light of the following detailed description of a best mode embodiment thereof, as illustrated in the accompanying drawings.

DESCRIPTION OF PREFERRED EMBODIMENTS

Figure 1:
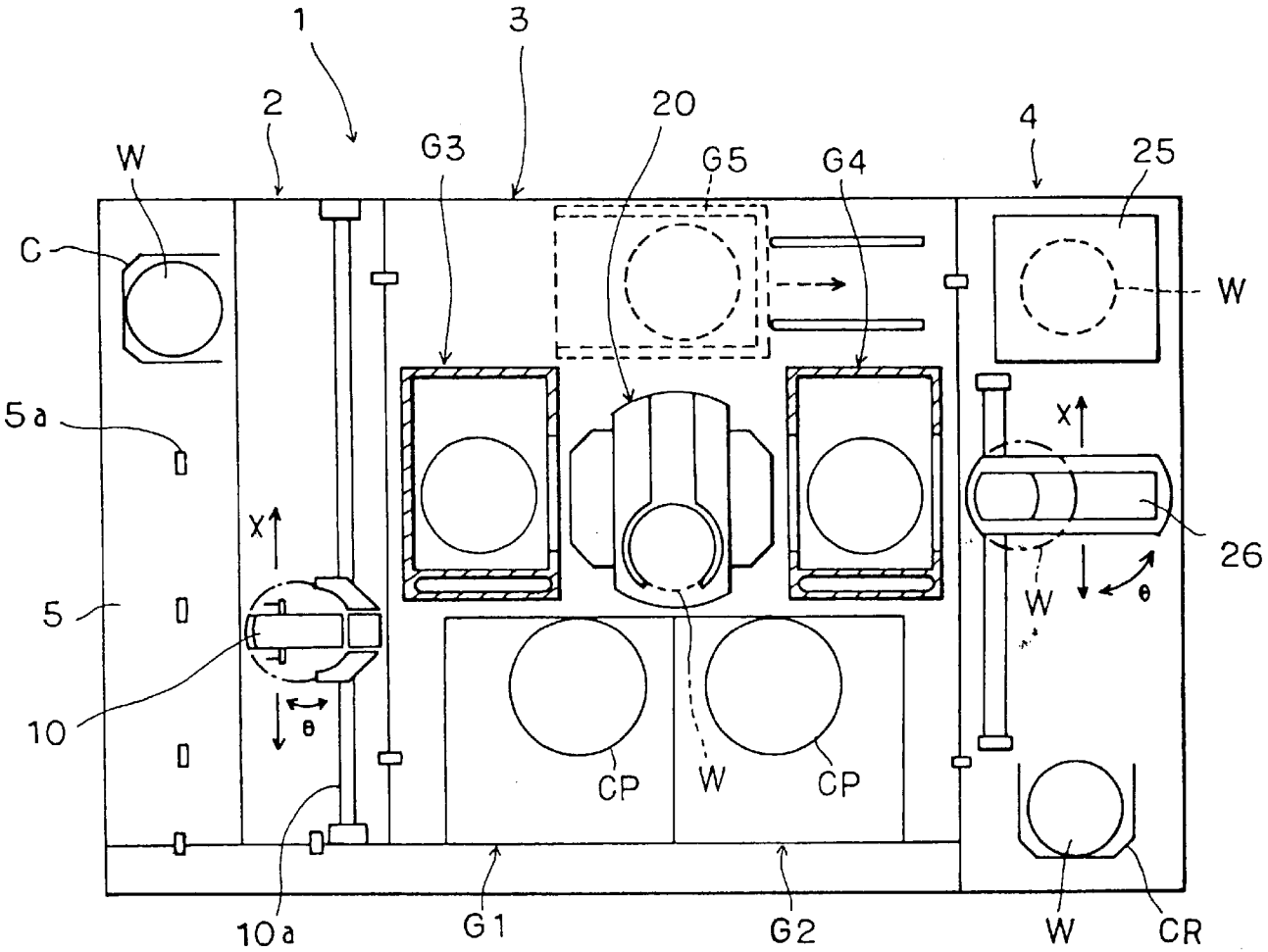
FIG. 1 is a perspective view showing the structure of a coating and developing system having a developing unit according to an embodiment of the present invention.

FIG. 1 shows the structure of a coating and developing system 1. The coating and developing system 1 comprises a cassette station 2, a processing station 3, and an interface portion 4 that are integrally disposed and connected. The cassette station 2 loads and unloads a cassette C containing for example 25 wafers W to/from the coating and developing system 1. In addition, the cassette station 2 loads and unloads a wafer W to/from the cassette C. The processing station 3 has various processing units arranged in a plurality of stages. Each of the processing units performs a particular process for each wafer W. The interface portion 4 transfers a wafer W between the processing station 3 and an exposing unit (not shown) disposed adjacent thereto.

The cassette station 2 has a plurality of cassettes C at alignment protrusions 5*a* on a cassette holding table 5 in such a manner that the cassettes C are arranged in X direction (the upper and lower directions of the drawing shown in FIG. 1) and wafer entrances of the cassettes C face the processing station 3. A wafer conveying portion 10 travels in the cassette C arrangement direction (X direction) and in the wafer W arrangement direction (Z direction that is the vertical direction of the drawing shown in FIG. 1) along a conveying path 10*a* of the wafer conveying portion 10 so that the wafer conveying portion 10 can selectively access each wafer W in each cassette C.

The wafer conveying portion 10 is also rotatable. As will be described, the wafer conveying portion 10 is accessible to an alignment unit (ALIM) and an extension unit (EXT) of a multiple-staged unit portion of a third processing unit group G3 of the processing station 3.

In the processing station 3, a main conveying unit 20 is disposed at a center portion thereof. At least one set of various multiple-staged processing units is disposed in the vicinity of the main conveying unit 20. In the coating and developing system 1, five processing unit groups G1, G2, G3, G4, and G5 can be disposed. The first and second processing unit groups G1 and G2 are disposed on the front side of the coating and developing system 1. The third processing unit group G3 is disposed adjacent to the cassette station 2. The fourth processing unit group G4 is disposed adjacent to the interface portion 4. The fourth processing unit group G4 is disposed on the rear side of the fifth processing unit group G5 denoted by a dashed line shown in FIG. 1.

Figure 2:
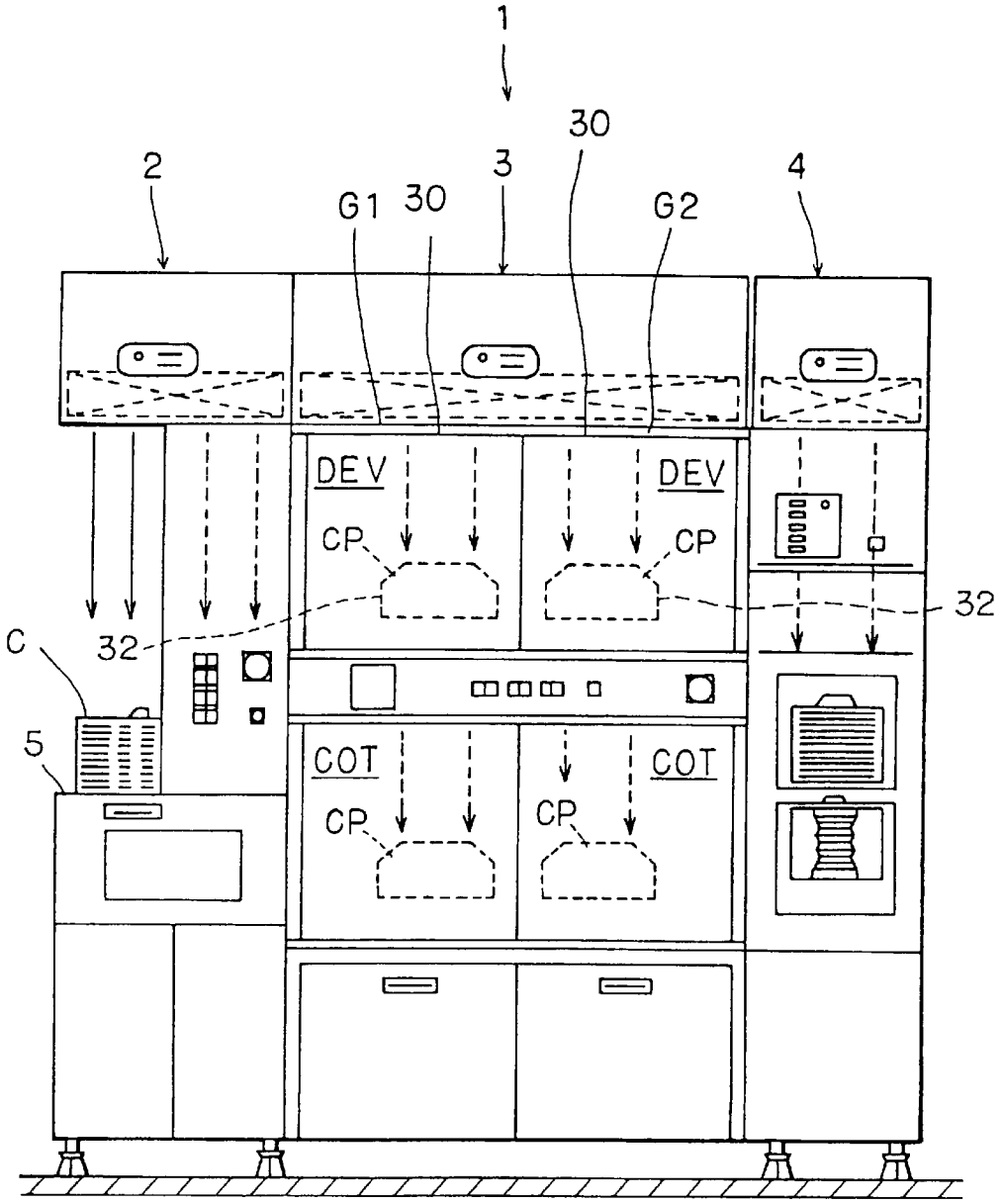
FIG. 2 is a plan view showing the structure of the coating and developing system shown in FIG. 1.

As shown in FIG. 2, in the first processing unit group G1, two spinner type processing units for example a resist coating unit (COT) and a developing unit 30 (DEV) that place a wafer W on a spin chuck in a cup 31 (CP) and perform a particular process are disposed in two stages as a lower unit and an upper unit, respectively. As with the first processing unit group G1, in the second processing unit group G2, two spinner type processing units for example a resist coating unit (COT) and a developing unit 30 (DEV) are disposed in two stages as a lower unit and an upper unit, respectively.

Figure 3:
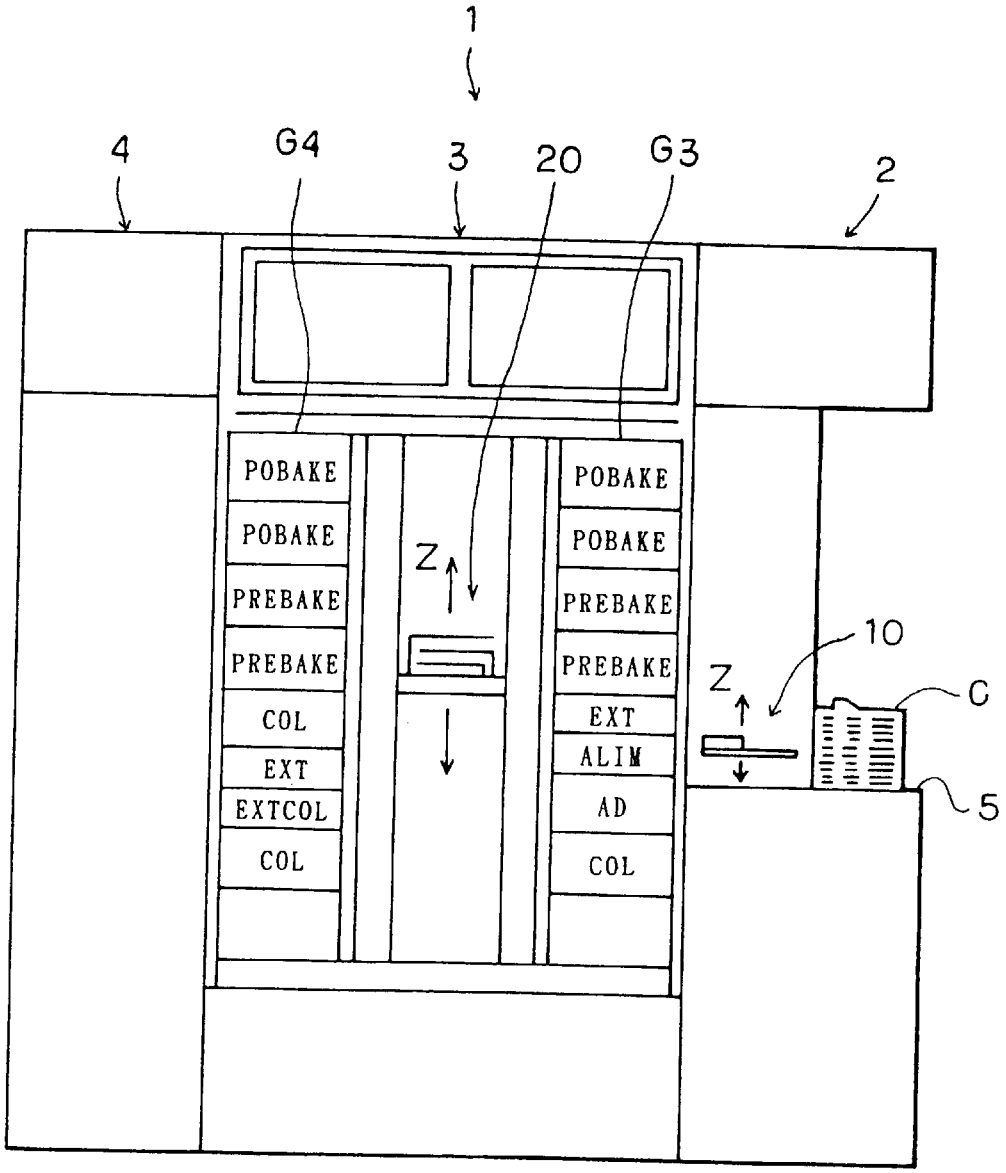
FIG. 3 is a rear view showing the structure of the coating and developing system shown in FIG. 1.

As shown in FIG. 3, in the third processing unit group G3, for example, a cooling unit (COL), a hydrophobic processing unit (AD), an alignment unit (ALIM), an extension unit (EXT), a pre-baking unit (PREBAKE), and a post-baking unit (POBAKE) are disposed in eight stages. The cooling unit (COL) performs a cooling process. The hydrophobic processing unit (AD) performs a hydrophobic process for improving the adherence of resist and a wafer W. The alignment unit (ALIM) aligns a wafer W. The extension unit (EXT) causes a wafer W to wait for the next process. The pre-baking unit (PREBAKE) and the post-baking unit perform heating processes. As shown in FIG. 3, in the fourth processing unit group G4, for example a cooling unit (COL), an extension cooling unit (EXTCOL), an extension unit (EXT), a cooling unit (COL), a pre-baking unit (PREBAKE), a post-baking unit (POBAKE), and so forth are disposed in eight stages.

As shown in FIG. 1, in the interface portion 4, a peripheral exposing unit 25 and a wafer conveying portion 26 are disposed. The peripheral exposing unit 25 is disposed at a rear surface portion of the interface portion 4. The wafer conveying portion 26 is disposed at a center portion of the interface portion 4. The wafer conveying portion 26 can be traveled in X direction and Z direction (vertical direction) and can be rotated in 2 direction. The wafer conveying portion 26 is accessible to a wafer transferring table (not shown) facing the extension unit (EXT) and an exposing unit (not shown) of the fourth processing unit group G4 of the processing station 3.

Figure 4:
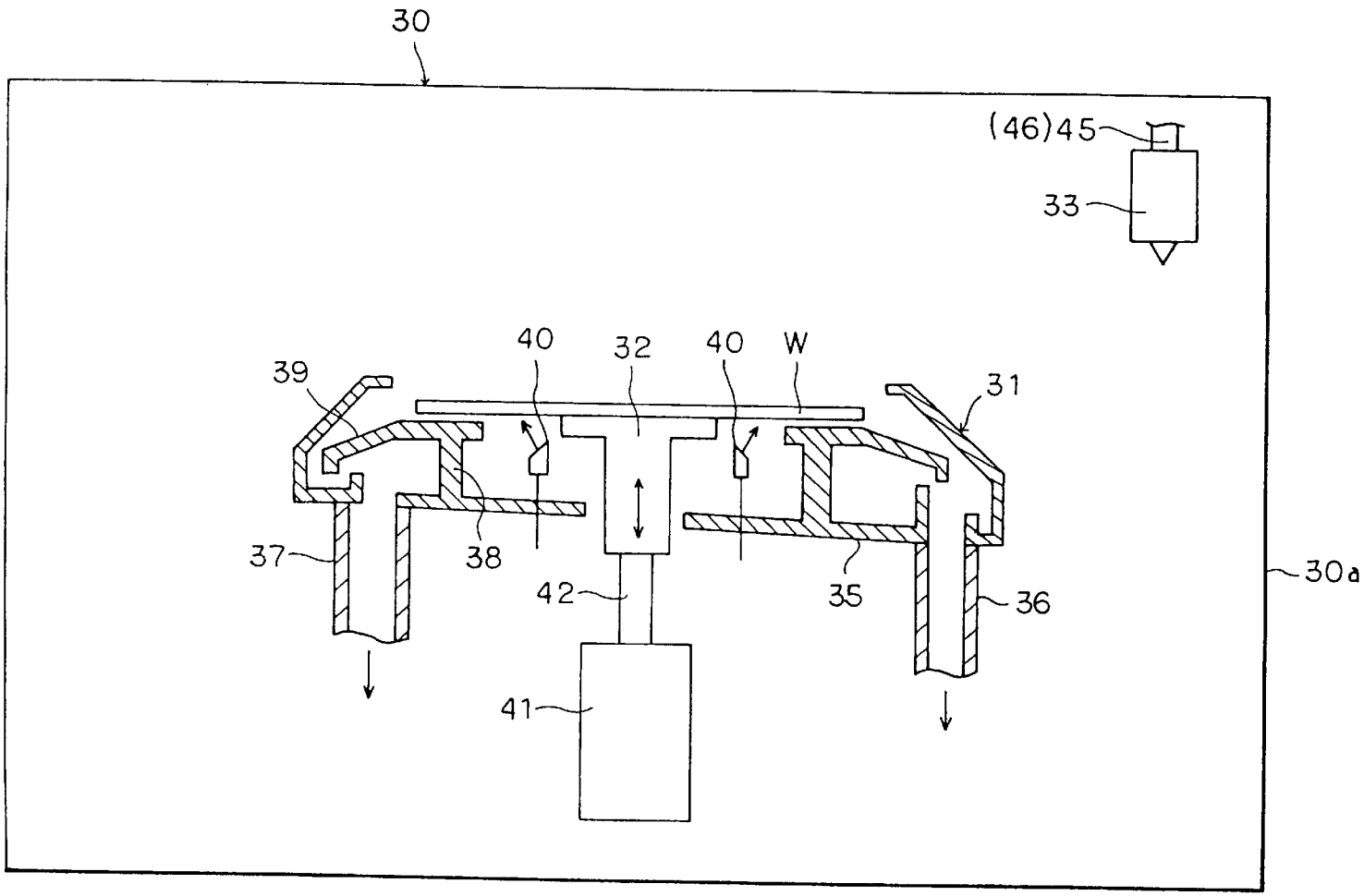
FIG. 4 is a sectional view showing an outlined structure of the developing unit according to the embodiment of the present invention.
Figure 5:
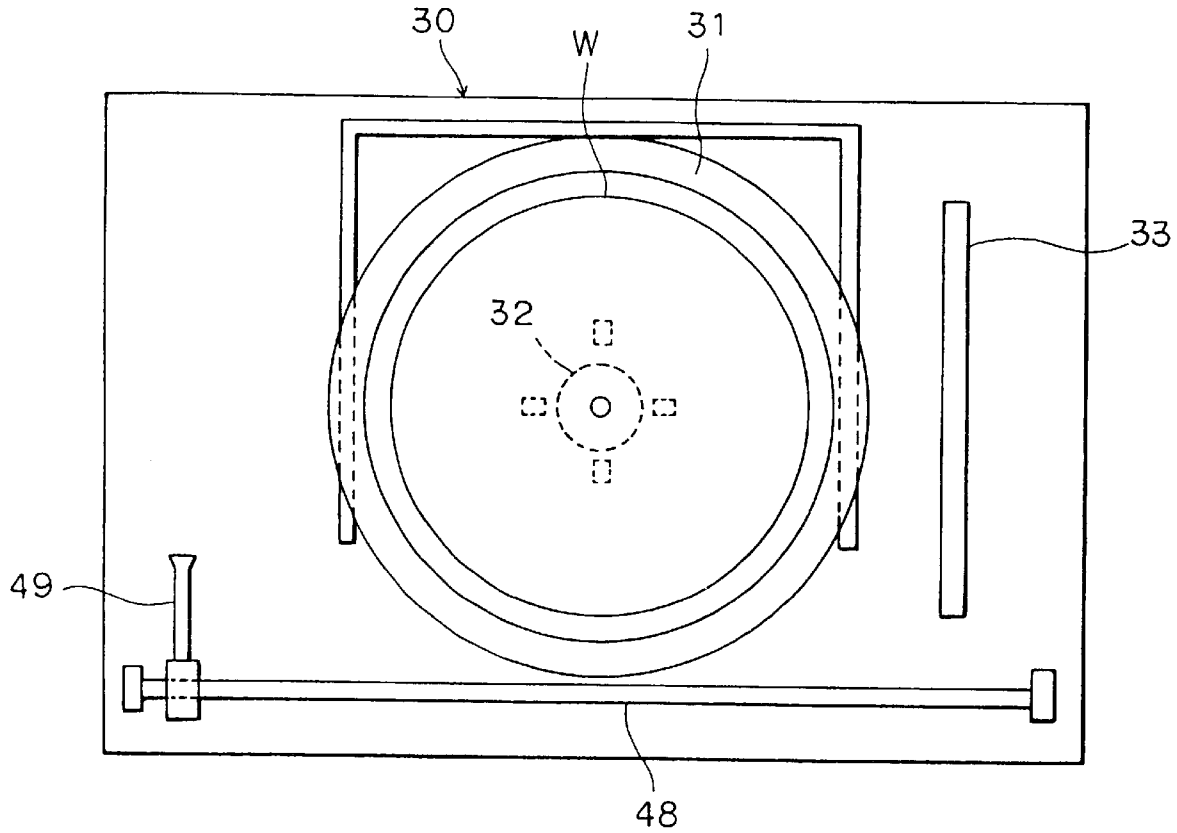
FIG. 5 is a plan view showing the outlined structure of the developing unit according to the embodiment of the present invention.

Next, the structure of the developing unit 30 disposed in the first processing unit group G1 of the coating and developing system will be described. FIG. 4 is a sectional view showing an outlined structure of the developing unit 30. FIG. 5 is a plan view of the developing unit 30.

The developing unit 30 comprises a casing 30*a*, a cup 31, a spin chuck 32, and a processing solution supplying nozzle portion 33. The casing 30*a* houses the cup 31, the spin chuck 32, and the processing solution supplying nozzle portion 33. The cup 31 has a ring-shaped upper opening. The spin chuck 32 horizontally holds a wafer W in the cup 31. The processing solution supplying nozzle portion 33 supplies developing solution and pure water to the front surface of a wafer W. When the developing process is performed, the processing solution supplying nozzle portion 33 supplies developing solution to the front surface of the wafer W. After the developing process is performed, the rinsing process is performed. When the rinsing process is performed, the processing solution supplying nozzle portion 33 supplies pure water to the front surface of the wafer W.

The cup 31 has an inclined bottom surface 35. A liquid drainage pipe 36 is connected to a bottom portion of the bottom surface 35. The liquid drainage pipe 36 drains developing solution and pure water that are used in the developing process and the rinsing process. A gas exhaust pipe 37 is connected on the opposite side of the liquid drainage pipe 36. The gas exhaust pipe 37 exhausts gas in the cup 31. A ring-shaped wall 38 is formed on the bottom surface 35 of the cup 31. A flow regulating plate 39 is disposed at the upper edge of the ring-shaped wall 38 adjacent to the rear surface of the wafer W, which held on the spin chuck 32 by suction. A peripheral portion of the flow regulating plate 39 inclines downwardly and outwardly. A rear surface rinsing nozzle portion 40 is disposed below the wafer W held by the spin chuck 32. The rear surface rinsing nozzle portion 40 supplies pure water for rinsing the rear surface of the wafer W.

The spin chuck 32 horizontally holds the wafer W on a holding surface thereof by suction. The spin chuck 32 is connected to a pillar 42 of a lifting and rotating mechanism 41 disposed below the cup 31. The rising and rotating mechanism 35 causes the spin chuck 32 to be raised and rotated.

Figure 6:
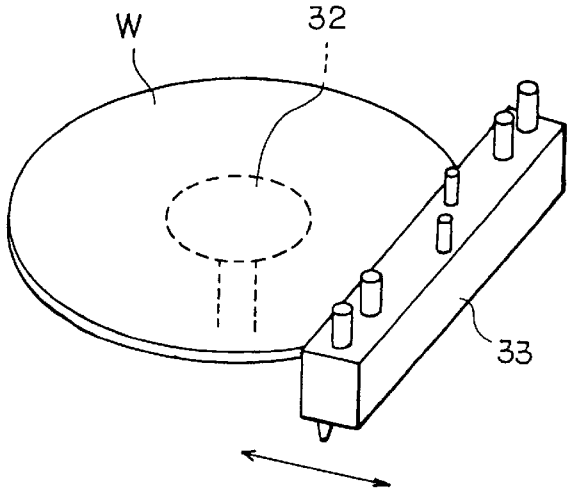
FIG. 6 is a perspective view showing a portion in the vicinity of a processing solution supplying nozzle portion of the developing unit according to the embodiment of the present invention.

A developing solution supplying path 45 and a pure water supplying path 46 are connected to the processing solution supplying nozzle portion 33. The developing solution supplying path 45 supplies developing solution to the processing solution supplying nozzle portion 33. The pure water supplying path 46 supplies pure water to the processing solution supplying nozzle portion 33. The processing solution supplying nozzle portion 33 supplies developing solution, pure water, and a mixture thereof. As shown in FIG. 5, the processing solution supplying nozzle portion 33 is held by a holding arm 49 that travels on a conveying rail 48. The processing solution supplying nozzle portion 33 can reciprocally travel in the directions denoted by arrows shown in FIGS. 5 and 6.

Figure 7:
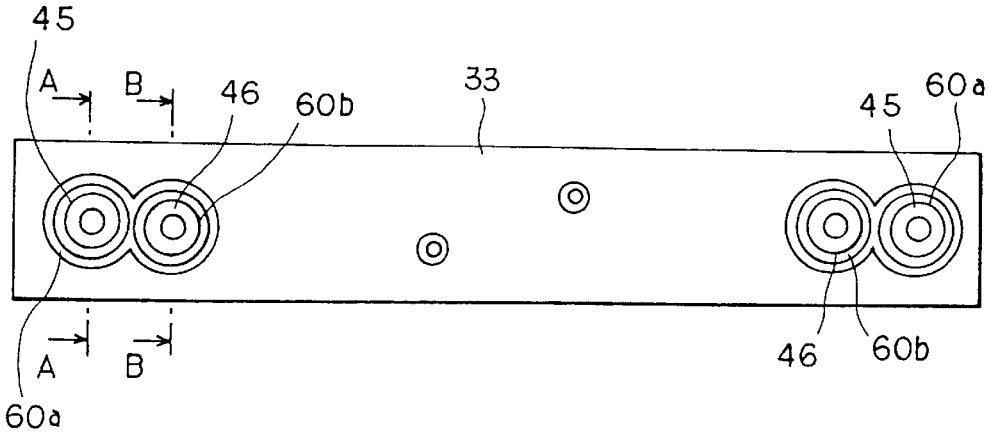
FIG. 7 is a plan view showing an outlined structure of the processing solution supplying nozzle portion.
Figure 8:
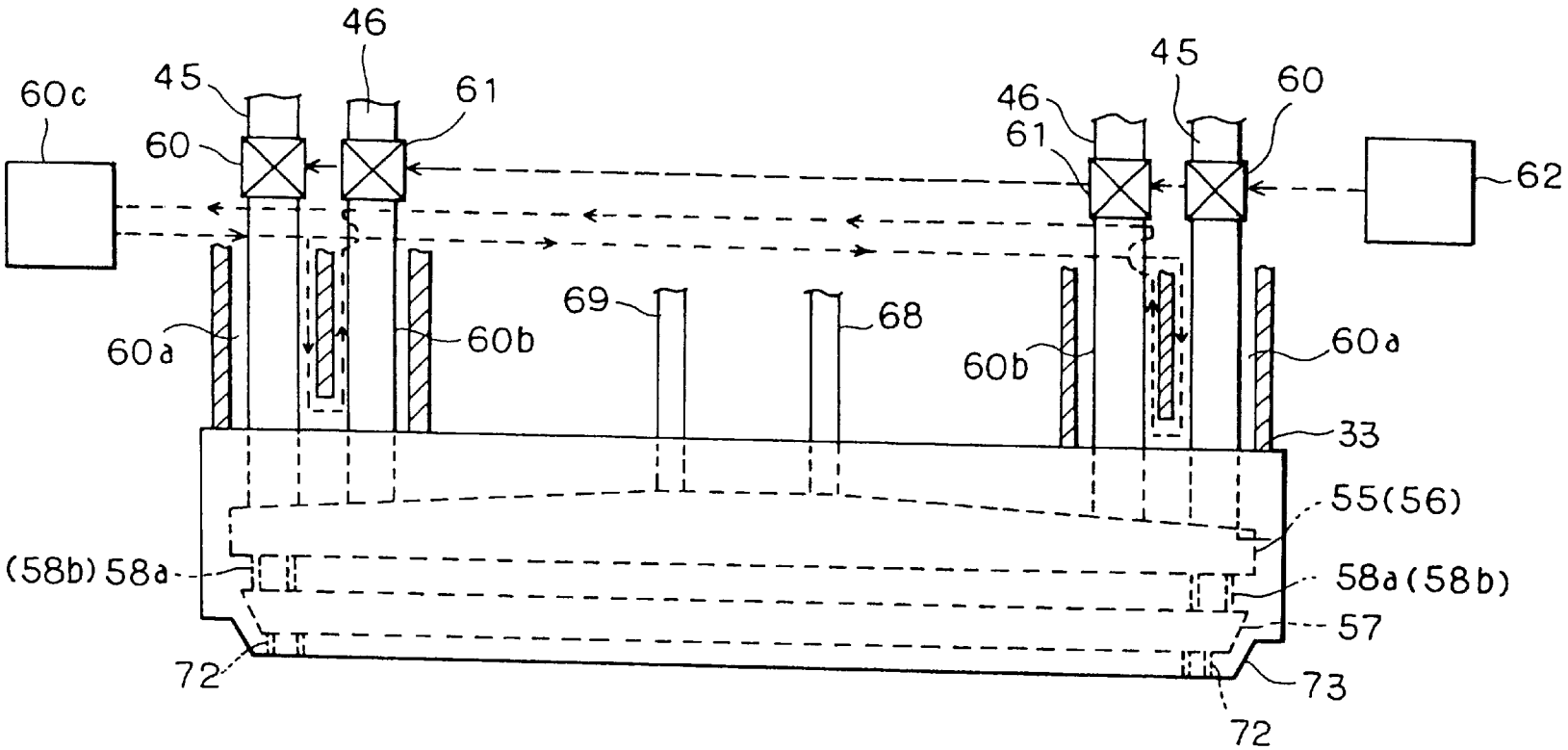
FIG. 8 is a side view showing the outlined structure of the processing solution supplying nozzle portion.
Figure 9:
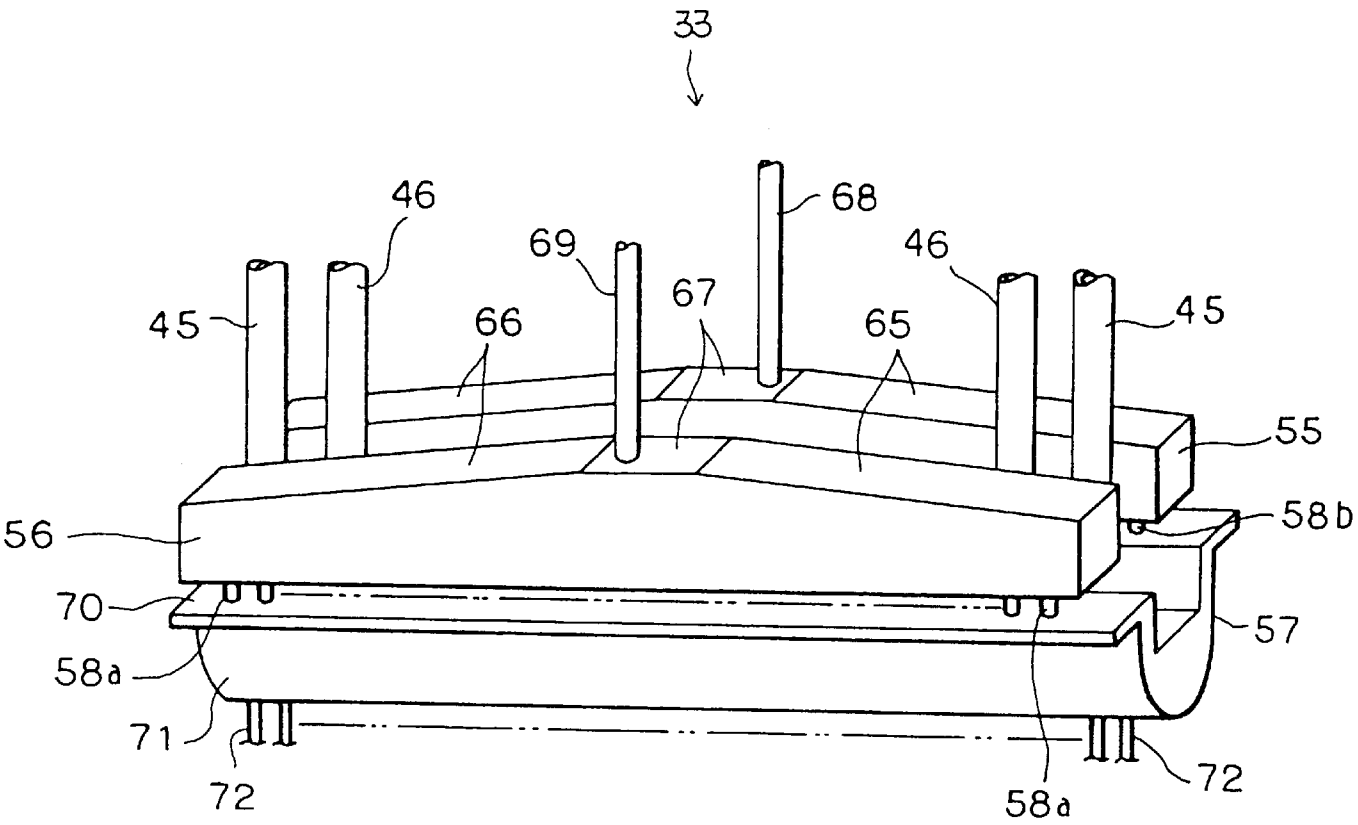
FIG. 9 is a perspective view showing the inside of the outlined structure of the processing solution supplying nozzle portion.
Figure 10:
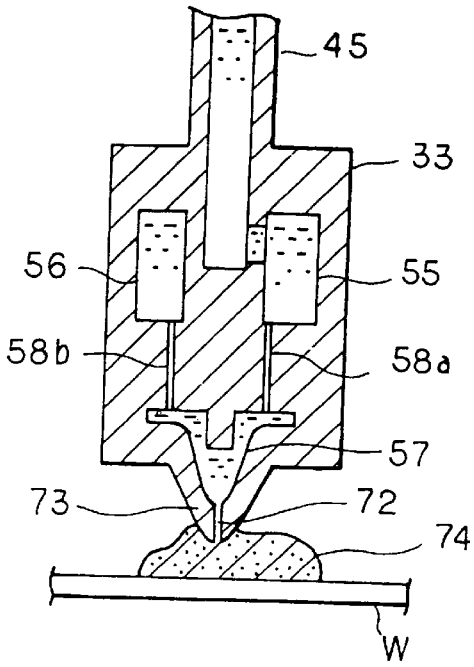
FIG. 10 is a sectional view taken along line A—A shown in FIG. 7.
Figure 11:
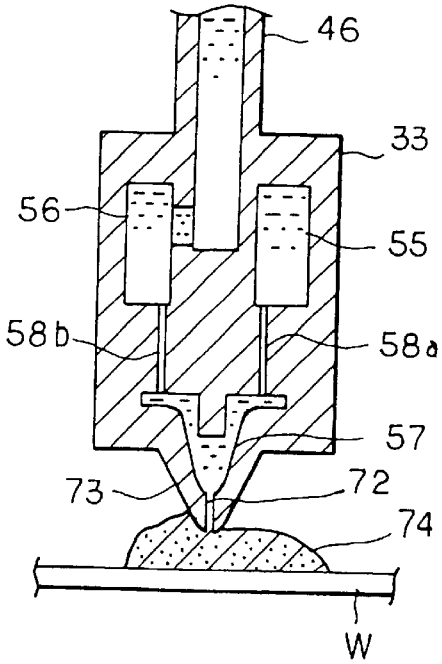
FIG. 11 is a sectional view taken along line B—B shown in FIG. 7.

Next, with reference to FIGS. 7 to 11, the structure of the processing solution supplying nozzle portion 33 will be described. FIG. 7 is a plan view showing the structure of the processing solution supplying nozzle portion 33. FIG. 8 is a side view showing the structure of the processing solution supplying nozzle portion 33. FIG. 9 is a perspective view showing the structure of the processing solution supplying nozzle portion 33. FIG. 10 is a sectional view taken along line A—A shown in FIG. 7. FIG. 11 is a sectional view taken along line B—B shown in FIG. 7.

As shown in FIGS. 7, 8, and 9, the developing solution supplying path 45 pierces each of the left and right portions of the processing solution supplying nozzle portion 33. The developing solution supplying path 45 is connected to a developing solution reservoir portion 55. Likewise, the pure water supplying path 46 pierces each of the left and right portions of the processing solution supplying nozzle portion 33. The pure water supplying path 46 is connected to a pure water reservoir portion 56. A mixing portion 57 is formed at a lower portion of the processing solution supplying nozzle portion 33. The developing solution reservoir portion 55 and the mixing portion 57 are connected through a connecting path 58*a*. The pure water reservoir portion 56 and the mixing portion 57 are connected through a connecting path 58*b*.

A first flow amount adjusting valve 60 is disposed in the middle of the developing solution supplying path 45. The first flow amount adjusting valve 60 adjusts the flow amount of developing solution that flows to the developing solution reservoir portion 55. Likewise, a second flow amount adjusting valve 61 is disposed in the middle of the pure water supplying path 46. The second flow amount adjusting value 61 adjusts the flow amount of pure water that flows to the pure water reservoir portion 56. A controlling portion 62 inputs an operation signal to the first flow amount adjusting valve 60 and the second flow amount adjusting valve 61 corresponding to the progress of the developing process so as to adjust the flow amount of the developing solution that flows to the developing solution reservoir portion 55 and the flow amount of the pure water that flows to the pure water reservoir portion 56.

The developing solution supplying path 45 and the pure water supplying path 46 are disposed between temperature adjusting pipes 60*a* and 60*b*. The developing solution supplying path 45 and the pure water supplying path 46 are connected on the upper surface of the processing solution supplying nozzle portion 33. Likewise, the temperature adjusting pipe 60*a* of the developing solution supplying path 45 and the temperature adjusting pipe 60*b* of the pure water supplying path 46 are connected on the upper surface of the processing solution supplying nozzle 33. Hot water whose temperature is maintained at around 23° C. is supplied from a temperature adjusted water supplying unit 60*c* to the temperature adjusting pipes 60*a* and 60*b*. The hot water is circulated from the temperature adjusting pipe 60*a* of the developing solution supplying path 45 to the temperature adjusting pipe 60*b* of the pure water supplying path 46. Thus, the temperature of developing solution supplied to the wafer W and the temperature of pure water supplied to the wafer W are maintained at a constant temperature. Since the temperature of pure water is also maintained, the temperature of the wafer W to which developing solution is supplied almost becomes equal to the temperature of the developing solution. Thus, the developing process can be stably performed free from developing defects or the like.

As shown in FIG. 9, the structure of the developing solution reservoir portion 55 is the same as the structure of the pure water reservoir portion 56. The developing solution reservoir portion 55 and the pure water reservoir portion 56 are symmetrically disposed at an upper portion of the processing solution supplying nozzle portion 33. For simplicity, the structure of only the developing solution reservoir portion 55 will be described. The developing solution reservoir portion 55 is formed in a rectangular parallelopiped shape along the longitudinal direction of the processing solution supplying nozzle portion 33. The upper surface of the developing solution reservoir portion 55 is composed of an upper-leftwardly inclined plane 65, an upper-rightwardly inclined plane 66, and a horizontal plane 67. The horizontal plane 67 is formed between the upper-leftwardly inclined plane 65 and the upper-rightwardly inclined plane 66. Air in the developing solution reservoir portion 55 flows to the outside through the inclined planes 65 and 66, and a first de-foaming path 68 connected to the horizontal plane 67. The structure of the pure water reservoir portion 56 is almost the same as the structure of the developing solution reservoir portion 55. Air in the pure water reservoir portion 56 flows to the outside through a second de-foaming path 69.

The mixing portion 57 has an upper plane 70 and a bottom surface 71. The upper plane 70 is formed in an almost concave shape. The lower plane 71 is formed in an almost U-letter shape. Left, right, front, and rear side planes of the mixing portion 57 are surrounded by the upper plane 70 and the bottom surface 71. On the bottom surface 71, many spraying paths 72 are formed in the longitudinal direction of the processing solution supplying nozzle portion 33. Solution in the mixing portion 57 is supplied from the spraying portion 73 to the front surface of the wafer W through the spraying paths 72.

In other words, as shown in FIG. 10, developing solution supplied from the developing solution supplying path 45 flows to the mixing portion 57 through the developing solution reservoir portion 55 and the connecting path 58*a*. As shown in FIG. 11, pure water supplied from the pure water supplying path 46 flows to the mixing portion 57 through the pure water reservoir portion 56 and the connecting path 58*b*. The developing solution and the pure water are mixed in the mixing portion 57. As shown in FIG. 10, the spraying portion 73 supplies a mixture 74 of developing solution and pure water to the front surface of the wafer W. In this case, the flow amount of the developing solution that flows to the developing solution reservoir portion 55 is adjusted by the first flow amount adjusting value 60. Likewise, the flow amount of the pure water that flows to the pure water reservoir portion 56 is adjusted by the second flow amount adjusting valve 61. Thus, the mixing portion 57 mixes the developing solution and the pure water at a predetermined mixing ratio. The mixing ratio of developing solution and pure water in the mixing portion 57 can be varied by adjusting the first flow amount adjusting value 60 and the second flow amount adjusting value 61. Thus, the concentration of the developing solution in the mixture can be gradually increased or decreased corresponding to the progress of a the developing process. Alternatively, by closing the second flow amount adjusting valve 61 of the pure water supplying path 46, only the developing solution flows to the mixing portion 57. Thus, only the developing solution can be supplied from the spraying portion 73 to the front surface of the wafer W through the spraying paths 72. Similarly, by closing the first flow amount adjusting valve 60 of the developing solution supplying path 45, only the pure water flows to the mixing portion 57. Thus, only the pure water can be supplied from the spraying portion 73 through the spraying paths 72 to the front surface of the wafer W.

Next, the process of the coating and developing system 1 having the developing unit 30 according to the embodiment of the present invention will be described.

In the coating and developing system 1, after the wafer conveying portion 10 of the cassette station 2 extracts an unprocessed wafer W from a cassette C in the cassette station 2, the wafer conveying portion 10 conveys the wafer W to the alignment unit (ALIM) of the third processing unit group G3 of the processing station 3. The alignment unit (ALIM) aligns the wafer W. Thereafter, the main conveying unit 20 extracts the wafer W from the rear side of the alignment unit (ALIM) and conveys the wafer W to the hydrophobic processing unit (AD) of the third processing unit group G3. After the cooling unit (COL) of the third processing unit group G3 or the fourth processing unit group G4 cools the wafer W, the resist coating unit (COT) of the first processing unit group G1 or the second processing unit group G2 coats a photoresist film (photosensitive film) on the wafer W.

Thereafter, the pre-baking unit (PREBAKE) of the third processing unit group G3 or the fourth processing unit group G4 performs a heating process for the wafer W so as to evaporate residual solvent from the photosensitive film of the wafer W. The extension cooling unit (EXTCOL) of the fourth processing unit group G4 cools the wafer W. After the extension unit (EXT) of the fourth processing unit group G4 holds the wafer W, the wafer conveying portion 26 extracts the wafer W from the rear side of the extension unit (EXT) and conveys the wafer W to the exposing unit (not shown). The exposing unit exposes the wafer W. Thereafter, the wafer conveying portion 26 conveys the wafer W to the extension unit (EXT) of the fourth processing unit group G4. The extension unit (EXT) transfers the wafer W to the main conveying unit 20. The main conveying unit 20 conveys the wafer W to the developing unit 30 (DEV) of the first processing unit group G1 or the second processing unit group G2. The developing unit 30 (DEV) develops the wafer W with developing solution and rinses the wafer with rinsing solution. Thus, the developing process is completed.

Next, with reference to FIGS. 12A to 12E, the developing process of the developing unit 30 will be described. When a wafer W is placed on the spin chuck 32 in the cup 31, the holding arm 49 holds the processing solution supplying nozzle portion and travels it to a position above the wafer W.

Figure 12:
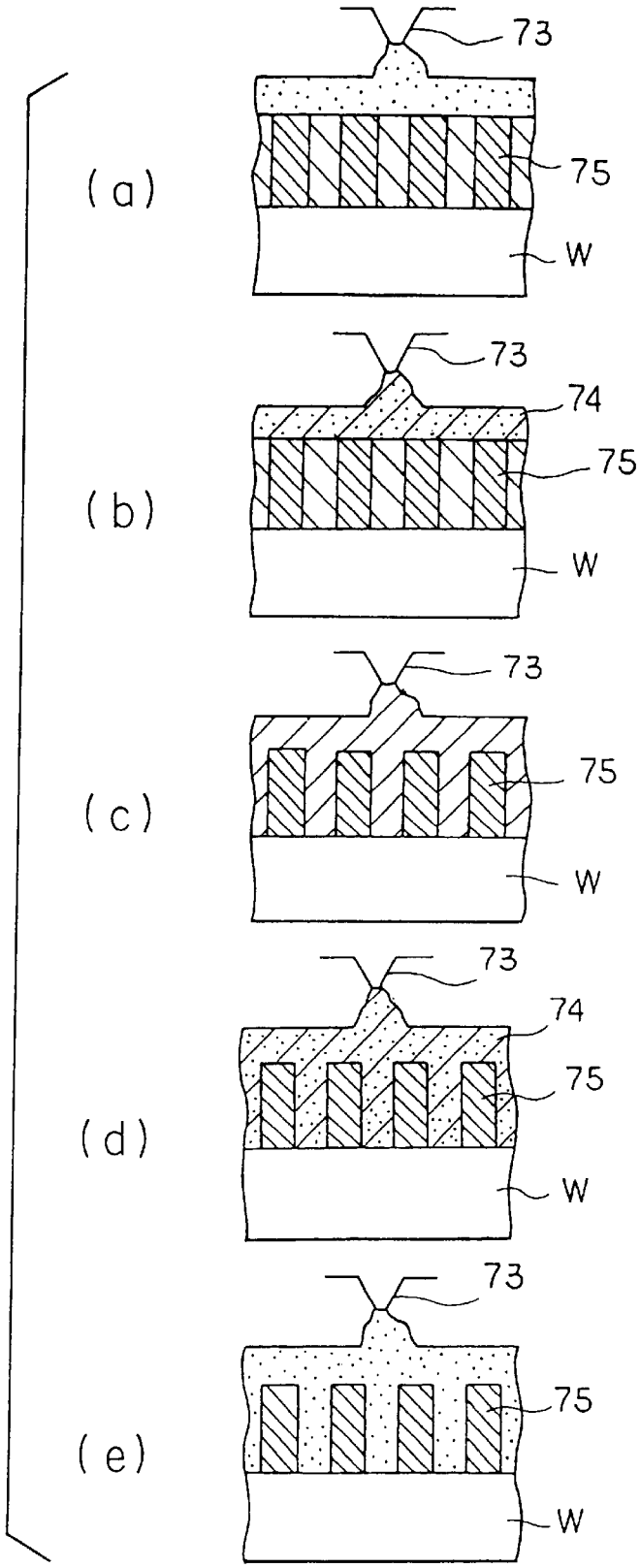
FIGS. 12(*a*) to 12(*e*) are sectional views showing steps a process of according to the embodiment of the present invention.

Next, the wafer W is rotated at low speed (for example, around 20 rpm). As shown in FIG. 8, while the first flow amount adjusting value 60 of the developing solution supplying path 45 is closed, the controlling portion 62 outputs a predetermined operation signal to the second flow amount adjusting valve 61 of the pure water supplying path 46 so as to open the second flow amount adjusting value 61. Pure water supplied from the pure water supplying path 46 flows to the mixing portion 57 through the pure water reservoir portion 56. Thus, as shown in FIG. 12A, only pure water is supplied to the front surface of the wafer W for a predetermined time period (for example around three seconds). Since the wafer W is rotated, the pure water equally spreads out as a liquid layer on the front surface of the wafer W. Since pure water is supplied to the front surface of the wafer W, rubbish thereon is removed. Thus, a defect caused by rubbish can be prevented. Since a pure water layer is formed at first, developing solution that is supplied next is prevented from directly contacting the wafer W. Thus, even if the developing solution contains micro-bubbles, they do not adversely affect the front surface of the wafer W. Consequently, unlike with the conventional system, a deaerating module that removes micro-bubbles from developing solution can be omitted.

Thereafter, the controlling portion 62 causes the wafer W to be rotated at high speed (around 1000 rpm) and outputs a predetermined operation signal to the first flow amount adjusting valve 60 so that the developing solution supplied from the developing solution supplying path 45 flows to the mixing portion 57 through the developing solution reservoir portion 55. Thus, as shown in FIG. 12B, a mixture of developing solution and pure water is supplied to the front surface of the wafer W for a predetermined time period (for example around two seconds). Thereafter, a developing solution component contained in the mixture dissolves an exposed portion of the resist film 75 formed on the front surface of the wafer W.

Figure 13:
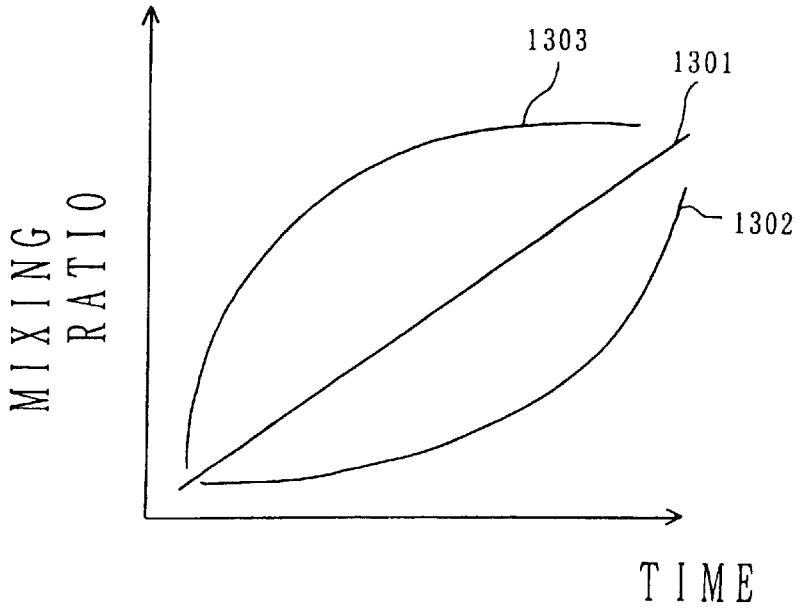
FIG. 13 is a graph showing the state of which the mixing ratio of developing solution is increased corresponding to the embodiment of the present invention.

In the initial state, the first flow amount adjusting valve 60 is not fully opened. Thus, developing solution and pure water are not initially mixed. In other words, the first flow amount adjusting valve 60 is gradually opened. In contrast, the second flow amount adjusting valve 61 is gradually closed. Thus, the mixing ratio of the developing solution in the mixture mixed in the mixing portion 57 is gradually increased. As a method for gradually increasing the mixing ratio of developing solution, the acceleration of the increasing the mixing ratio of developing solution is maintained constant as denoted by reference numeral 1301 shown in FIG. 13. As another method, the acceleration of the increasing mixing ratio of developing solution is gradually increased as denoted by reference numeral 1302 shown in FIG. 13. As a further method, the acceleration of the increasing mixing ratio of developing solution is gradually decreased as denoted by reference numeral 1303. In the case that the acceleration of the increasing mixing ratio of developing solution is gradually increased, in particular, when the developing speed of the developing solution is fast, the developing process in the direction of the line width can be delayed. Thus, the line width becomes relatively stable. In contrast, in the case that the acceleration of the increasing mixing ratio of the developing solution is gradually decreased, since developing solution with high concentration is initially supplied, the developing process can be equally performed. In addition, the developing speed can be increased further.

Next, the controlling portion 62 causes the wafer W to be rotated at low speed (for example, 30 rpm), the first flow amount adjusting valve 60 to be fully opened, and the second flow amount adjusting valve 61 to be closed. Only the developing solution is supplied to the front surface of the wafer W for a predetermined time period (for example, around 1.3 seconds) (see FIG. 12C). Since the concentration of the developing solution is gradually and chronologically varied, the processing solution supplied to the front surface of the wafer W is substituted from pure water to developing solution. Thus, a developing solution component and a resist component gradually react. Consequently, even if a resist component dissolves in a mixture of developing solution and pure water, the equality of the concentration of developing solution can be properly maintained.

The developing solution is equally supplied as a liquid layer to the front surface of the wafer W. The rotation of the wafer W is stopped for a predetermined time period (for example, around 60 seconds). In this time period, a predetermined developing process is performed. Unlike with the conventional method, since developing solution is not only supplied, an unequal developing process due to a dissolved resist component can be suppressed. Thus, the circuit pattern can be developed in such a manner that the line width does not deviate.

Thereafter, the wafer W is rotated at high speed (for example, around 1500 rpm). In this state, a rinsing process is performed for a predetermined time period (for example, around 15 seconds). The controlling portion 62 outputs a predetermined operation signal to the second flow amount adjusting valve 61 so that the pure water supplied from the pure water supplying path 46 flows to the mixing portion 57 through the pure water reservoir portion 56. Thus, as shown in FIG. 12D, a mixture of pure water and developing solution is supplied to the front surface of the wafer W. Likewise, in the initial state, the second flow amount adjusting valve 61 is not fully opened. Thus, developing solution and pure water are not mixed. In other words, the second flow amount adjusting valve 61 is gradually opened. In contrast, the first flow amount adjusting valve 60 is gradually closed. Thus, the mixing ratio of developing solution in the mixture mixed in the mixing portion 57 is gradually decreased. Thereafter, the second flow amount adjusting valve 61 is fully opened. The controlling portion 62 does not input a predetermined operation signal to the first flow amount adjusting valve 60 so as to close the first flow amount adjusting valve 60. Thus, only pure water is supplied to the front surface of the wafer (see FIG. 12E).

Thus, in the initial state, developing solution is not changed to pure water. Instead, processing solution supplied to the front surface of the wafer W is gradually substituted from developing solution to pure water. Thus, the substitution from developing solution to pure water is gradually performed. Consequently, a resist component that has not dissolved in developing solution on the front surface of the wafer W is prevented from solidifying and adhering to the front surface of the wafer W. As a result, particles are prevented from forming.

In addition, with the first flow amount adjusting value 60 and the second flow amount adjusting valve 61 switched, only developing solution or pure water is supplied from the processing solution supplying nozzle portion 33. Thus, the transition time from the developing process to the rinsing process can be shortened. In addition, since the developing process and the rinsing process can be performed with one processing solution supplying nozzle portion 33, the structure of the developing unit 30 can be simplified.

Thereafter, the wafer W is rotated at high speed (for example, around 4000 rpm). In this state, a drying process is performed for a predetermined time period (for example, around 10 seconds).

After the drying process is completed, the main conveying unit 20 unloads the wafer W from the developing unit 30 and conveys the wafer W to the post-baking unit (POBAKE) of the third processing unit group G3 or the fourth processing unit group G4. The post-baking unit (POBAKE) performs a heating process for the wafer W. The cooling unit (COL) of the third processing unit group G3 or the fourth processing unit group G4 cools the wafer W. The extension unit (EXT) of the third processing unit group G3 holds the wafer W. The wafer conveying portion 10 unloads the wafer W from the opposite side of the extension unit (EXT) and loads the wafer W to a relevant cassette C in the cassette station 2.

Thus, according to the above-described embodiment, when the developing process is performed, after pure water is supplied to the front surface of the wafer W, a mixture of developing solution and pure water is supplied while the mixing ratio of developing solution against pure water is gradually increased. Thus, a processing solution supplied to the front surface of the wafer W is gradually changed from pure water to developing solution. Consequently, a developing solution component and a resist component gradually react. Even if a resist component dissolves in the mixture of pure water and developing solution, the equality of the concentration of developing solution can be properly maintained. Consequently, the developing solution can be prevented from being unequally performed. When the rinsing process is performed, a mixture of developing solution and pure water is supplied to the front surface of the wafer while the mixing ratio of developing solution to pure water is gradually decreased. Thus, a processing solution supplied to the front surface of the wafer W is gradually changed from developing solution to pure water. Consequently, the substitution from developing solution to pure water can be gradually performed. As a result, particles due to the solidification of undissolved resist is prevented. In addition, since the developing process and the rinsing process are performed with one processing solution supplying nozzle portion 33, the process time is shortened. In addition, the structure of the developing unit 30 is simplified.

As another developing process of the above-described embodiment, rather than initially supplying only pure water, a mixture of developing solution and pure water may be supplied to the front surface of the wafer W while the mixing ratio of developing solution to pure water is gradually increased. In this case, the developing process is performed at steps shown in FIGS. 12B to 12E. In this case, since a step for supplying only pure water is omitted, the throughput improves. As with the above-described embodiment, an unequally performed developing process is suppressed. This developing process is the same as the developing process of the above-described embodiment except that the step shown in FIG. 12A is omitted.

Alternatively, rather than chronologically varying the concentration of developing solution, a mixture of developing solution and pure water that are mixed at a predetermined mixing ratio may be supplied. In this case, at steps shown in FIGS. 12B and 12C, the mixture of developing solution and pure water mixed at the predetermined mixing ratio is supplied. In addition, when the developing process is performed, rather than initially supplying pure water, a mixture of developing solution and pure water may be supplied to the front surface of the wafer W. In this case, the developing process is performed at steps shown in FIGS. 12B to 12E.

Figure 14:
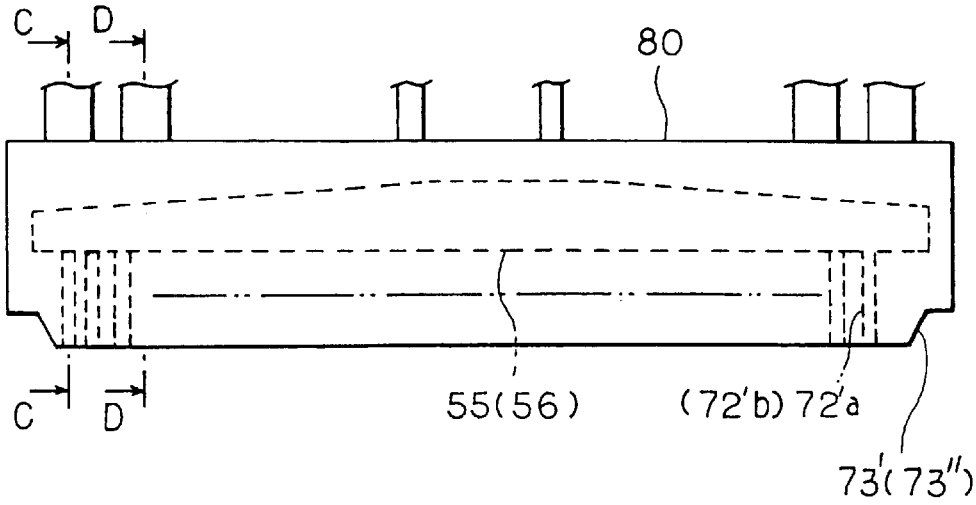
FIG. 14 is a sectional view showing an outlined structure of a processing solution supplying nozzle portion that does not have a mixing portion according to another embodiment of the present invention.

Next, a processing solution supplying nozzle portion 80 according to another embodiment of the present invention will be described. The processing solution supplying nozzle portion 80 has a mixing portion 57 that is different from that of the processing solution supplying nozzle portion 33 according to the first embodiment of the present invention. As shown in FIG. 14, the processing solution supplying nozzle portion 80 has a developing solution spraying portion 73' and a pure water spraying portion 73". The structure of the processing solution supplying nozzle portion 80 is the same as the structure of the processing solution supplying nozzle portion 33 except for the developing solution spraying portion 73' and the pure water spraying portion 73". For simplicity, in FIG. 14, similar portions to those in FIG. 8 are denoted by similar reference numerals and their description will be omitted.

Figure 15:
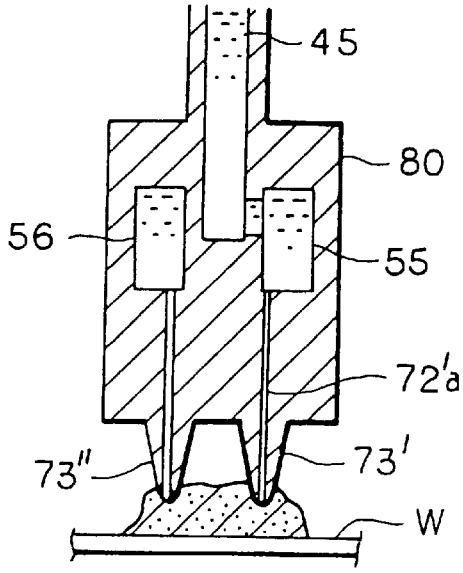
FIG. 15 is a sectional view taken along line C—C shown in FIG. 14.
Figure 16:
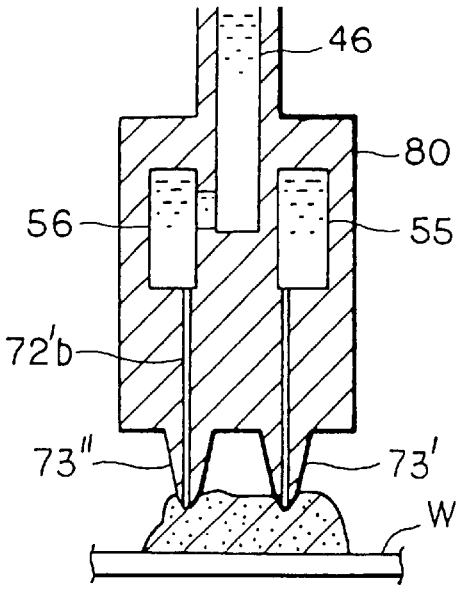
FIG. 16 is a sectional view taken along line D—D shown in FIG. 14.

FIG. 15 is a sectional view taken along line C—C shown in FIG. 14. FIG. 16 is a sectional view taken along line D—D shown in FIG. 14. As shown in FIG. 15, developing solution is supplied from a developing solution supplying path 45 to the front surface of the wafer W through a developing solution reservoir portion 55, a developing solution path 72'*a* and the spraying portion 73'. On the other hand, as shown in FIG. 16, pure water is supplied from a pure water supplying path 46 to the front surface of the wafer W through a pure water reservoir portion 56, a pure water path 72'*b*, and the spraying portion 73". The processing solution supplying nozzle portion 80 supplies developing solution and pure water on the front surface of the wafer W rather than internally mixing developing solution and pure water so that they are mixed as a liquid layer thereon.

Figure 17:
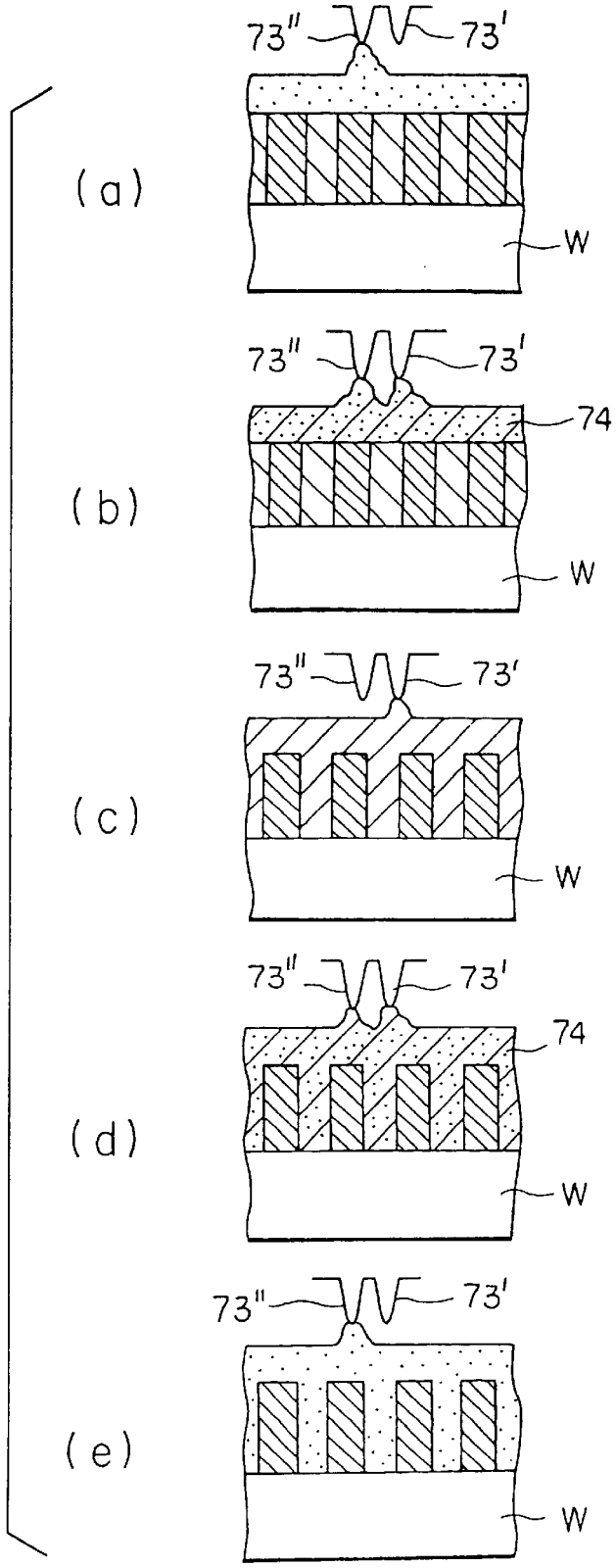
FIGS. 17(*a*) to 17(*e*) are sectional views showing steps of a process with the processing solution supplying nozzle portion that does not have a mixing portion.
Figure 18:
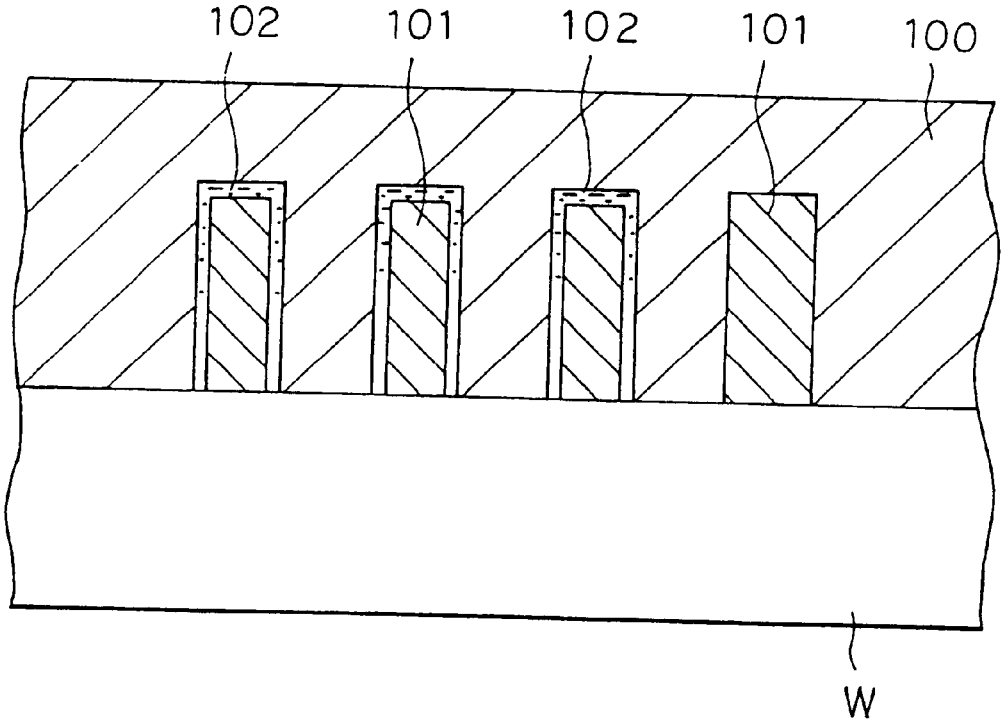
FIG. 18 is a sectional view showing an example of the surface structure of a wafer in the case that a conventional developing process is performed.

Next, with reference to FIGS. 17A to 17E, the process of the processing solution supplying nozzle portion 80 that does not have such a mixing portion will be described. As shown in FIG. 17A, only pure water is supplied from the spraying portion 73" to the front surface of the wafer W. As shown in FIG. 17B, developing solution is supplied from the spraying portion 73' to the front surface of the wafer W. Thus, developing solution and pure water are separately supplied to the front surface of the wafer W. As with the step shown in FIG. 12B, a first flow amount adjusting valve 60 is gradually opened. In contrast, a second flow amount adjusting valve 61 is gradually closed. Thus, the developing solution and pure water are mixed on the front surface of the wafer W while the mixing ratio of developing solution against pure water is gradually increased. Thereafter, the first flow amount adjusting valve 60 is fully opened. A controlling portion 62 does not output a predetermined operation signal to the second flow amount adjusting valve 61 so as to close the second flow amount adjusting valve 61. Thus, only developing solution is supplied to the front surface of the wafer W (see FIG. 17C). The developing solution is equally supplied as a liquid layer to the front surface of the wafer W. The rotation of the wafer W is stopped for a predetermined time period. In this state, a predetermined developing process is performed.

Thereafter, the wafer W is rotated at high speed. In this state, a rinsing process is performed. As shown in FIG. 17D, developing solution is supplied from the spraying portion 73'. In addition, pure water is supplied from the spraying portion 73". Thus, the developing solution and the pure water are separately supplied to the front surface of the wafer W. In this case, as with the step shown in FIG. 12D of the first embodiment, the second flow amount adjusting valve 61 is gradually opened and the first flow amount adjusting valve 60 is gradually closed. Thus, developing solution and pure water are mixed on the front surface of the wafer W while the mixing ratio of developing solution to pure water is gradually decreased. Thereafter, the second flow amount adjusting valve 61 is filly opened and the first flow amount adjusting valve 60 is closed. Thus, only pure water is supplied to the front surface of the wafer W (see FIG. 17E).

Thus, with the processing solution supplying nozzle portion 80 that does not have a mixing portion, when the developing process is performed, after pure water is supplied to the front surface of the wafer W, developing solution and pure water are separately supplied. Developing solution and pure water are mixed on the front surface of the wafer W while the mixing ratio of developing solution against pure water is gradually increased. Thus, a processing solution supplied to the front surface of the wafer W is gradually increased from pure water to developing solution. Thus, as with the first embodiment, a developing solution component and a resist component gradually react. Consequently, the equality of the concentration of developing solution can be properly maintained. Thus, the an unequally performed developing process is suppressed. When the rinsing process is performed, developing solution and pure water are separately supplied. Developing solution and pure water are mixed on the front surface of the wafer W while the mixing ratio of the developing solution to the pure water is gradually decreased. Thus, a processing solution supplied to the front surface of the wafer W is gradually increased from developing solution to pure water. Consequently, as with the first embodiment, the substitution from developing solution to pure water is gradually performed. As a result, particles due to the solidification of undissolved resist is prevented. In addition, since the developing process and the rinsing process are performed with one processing solution supplying nozzle portion 80, the process time is shortened. In addition, the structure of the developing unit 30 is simplified.

As another developing process of the processing solution supplying nozzle portion 80 that does not have a mixing portion, rather than initially supplying pure water, developing solution and pure water are separately supplied to the front surface of the wafer W. Developing solution and pure water are mixed on the front surface of the wafer W while the mixing ratio of developing solution to pure water is gradually increased. In this case, the developing process is performed at steps shown in FIGS. 17B to 17E. In this case, since a step for supplying only pure water is omitted, the throughput improves. As with the second embodiment, the unequally performed developing process is suppressed. This developing process is the same as the developing process of the second embodiment except that the step shown in FIG. 17A is omitted.

Alternatively, rather than chronologically varying the concentration of developing solution, developing solution and pure water may be separately supplied. The developing solution and the pure water may be mixed on the front surface of the wafer W at a predetermined mixing ratio. In this case, at steps shown in FIGS. 17B and 17D, developing solution and pure water whose flow rates are pre-adjusted are separately supplied so that the developing solution and the pure water are mixed at a predetermined mixing ratio. When the developing process is performed, rather than initially supplying pure water, developing solution and pure water may be separately supplied so that developing solution and the pure water are mixed at a predetermined mixing ratio on the front surface of the wafer W. In this case, the developing process is performed at steps shown in FIGS. 17B to 17E.

The present invention is not limited to the above-described embodiments. Instead, the present invention can be applied to various embodiments. For example, the substrate is not limited to a wafer W. Instead, the substrate may be an LCD substrate, a glass substrate, a CD substrate, a photo-mask, a printed circuit board, a ceramics substrate, or the like.

According to the present invention, when the developing process is performed, a developing solution component and a resist component gradually react. Thus, the equality of the concentration of developing solution can be properly maintained. Consequently, the developing process can be suppressed from being unequally performed. When the rinsing process is performed, the substitution from developing solution to pure water can be gradually performed. Thus, particles due to the solidification of unsolved resist can be prevented. As a result, a highly integrating technology for a substrate can be accomplished.

In the unit according to the present invention, since the developing process and the rinsing process are performed with one supplying means, the process time can be shortened. In addition, the structure of the developing unit can be simplified.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A unit for supplying developing solution to a front surface of a substrate, comprising:

a first supplying path that supplies a developing solution, the developing solution being adapted to developing a positive resist;

a second supplying path that supplies pure water;

a mixing portion connected to said first supplying path and second supplying path, the mixing portion being configured to mix the developing solution supplied from the first supplying path and the pure water supplied from the second supplying path, thereby to make a mixture of the developing solution and the pure water; and a spraying portion that sprays the mixture to the substrate;

a supplying head, disposed above the substrate, having said mixing portion and said spraying portion;

wherein said supplying head has:

a developing solution reservoir portion that temporarily reserves developing solution supplied from said first supplying path; and a pure water reservoir portion for that temporarily reserving reserves pure water supplied from said second supplying path.

2. The unit as set forth in claim 1, further comprising:

a first flow amount adjuster disposed in said first supplying path, that adjusts the flow amount of developing solution supplied to said mixing portion; and a second flow amount adjuster disposed in said second supplying path, that adjusts the flow amount of pure water supplied to said mixing portion.

3. A method for performing a developing process for a front surface of a substrate, comprising the steps of:

(a) mixing a developing solution and pure water in an area remote from the substrate, thereby making a first mixing solution with a first mixing ratio of the developing solution;

(b) supplying the first mixing solution to the front surface of the substrate; and (c) supplying a second mixing solution of the developing solution and the pure water with a second mixing ratio of the developing solution to the front surface of the substrate, the second mixing ratio being greater than the first mixing ratio, wherein the step (c) is preceded by the step (b).

4. The method as set forth in claim 3, wherein the second mixing ratio of the developing solution is gradually increased during the step (c) is being executed.

5. The method as set forth in claim 4, wherein an increasing rate of the second mixing ratio of the developing solution is gradually increased.

6. The method as set forth in claim 4, wherein an increasing rate of the second mixing ratio of the developing solution is gradually decreased.

7. The method as set forth in claim 3, further comprising the step of:

(d) mixing the developing solution and the pure water at an area away from the substrate, thereby making the second mixing solution with a second mixing ratio of the developing solution.

8. The method as set forth in claim 3, further comprising the step of:

(e) supplying the pure water to the front surface of the substrate, wherein the step (a) is preceded by the step (e).

9. The method as set forth in claim 3, further comprising the step of:

(f) supplying a third mixing solution of the developing solution and the pure water with a third mixing ratio of the developing solution to the front surface of the substrate, the third mixing ratio being less than the second mixing ratio, wherein the step (f) is preceded by the step (c).

10. A method for performing a developing process for the front surface of a substrate, comprising the steps of:

(a) supplying a mixture of a developing solution and pure water to the front surface of the substrate;

(b) supplying the developing solution to the front surface of the substrate; and (c) adjusting the temperatures of the developing solution and pure water supplied to the front of the substrate, wherein the step (b) is preceded by the step (a).

11. A method for performing a developing process for the front surface of a substrate, comprising the steps of:

(a) supplying a developing solution to the front surface of the substrate, (b) supplying a mixture of the developing solution and pure water to the front surface of the substrate; and (c) adjusting temperatures of the developing solution and pure water supplied to the front of the substrate.

12. The method as set forth in claim 11, wherein the step (b) is performed while the mixing ratio of the developing solution to pure water is gradually increased.

13. The method as set forth in claim 11, wherein the step (b) is performed by separately supplying the developing solution and pure water to the front surface of the substrate so that the developing solution and the pure water are mixed at a predetermined mixing ratio on the front surface of the substrate.

14. The method as set forth in claim 11, further comprising the step (d) of supplying pure water to the front surface of the substrate, wherein the step (d) is preceded by step (b).

15. A unit for supplying developing solution to a front surface of a substrate, comprising:

a first supplying path that supplies a developing solution;

a second supplying path that supplies pure water;

a mixing portion connected to said first supplying path and second supplying path, the mixing portion being configured to mix the developing solution supplied from the first supplying path and the pure water supplied from the second supplying path, thereby to make a mixture of the developing solution and the pure water;

a spraying portion that sprays the mixture to the substrate; and a supplying head disposed above the substrate and having the mixing portion and the spraying portion, the supplying head having a developing solution reservoir portion that temporarily reserves the developing solution supplied from the first supplying path and a pure water reservoir portion that temporarily reserves the pure water supplied from said second supplying path.

* * * * *